US006394152B1

(12) United States Patent
Martin

(10) Patent No.: US 6,394,152 B1
(45) Date of Patent: May 28, 2002

(54) SYSTEM AND METHOD FOR AUTOMATICALLY DISPENSING PAINT INTO A PAINT ROLLER TRAY

(76) Inventor: Steven Phillip Martin, 235 Encino Vista Dr., Thousand Oaks, CA (US) 91362

( * ) Notice: Subject to any disclaimer, the term of this patent is extended or adjusted under 35 U.S.C. 154(b) by 0 days.

(21) Appl. No.: 09/756,806

(22) Filed: Jan. 9, 2001

(51) Int. Cl.[7] ..... B65B 1/04; B65B 3/00; B67C 3/00

(52) U.S. Cl. ..... 141/351; 141/18; 141/347; 141/352

(58) Field of Search ..... 141/18, 192, 86, 141/346–352, 329, 330, 247; 220/570, 571, 571.1, 572

(56) References Cited

U.S. PATENT DOCUMENTS

| | | | | | |
|---|---|---|---|---|---|
| 2,095,351 | A | * | 10/1937 | Van Winkle | 141/86 |
| 2,600,197 | A | | 6/1952 | Braun | |
| 3,395,828 | A | | 8/1968 | Schnabel | |
| 3,590,416 | A | | 7/1971 | Henningsen | |
| 4,199,836 | A | | 4/1980 | Lovmark | |
| 4,691,838 | A | | 9/1987 | Graham et al. | |
| 4,852,759 | A | * | 8/1989 | Williams et al. | 220/85 H |
| 5,123,576 | A | | 6/1992 | Lawrence | |
| 5,291,921 | A | * | 3/1994 | Devine | 141/86 |
| D383,797 | S | | 9/1997 | Finnegan | |
| 5,787,544 | A | * | 8/1998 | Meade | 15/257.06 |
| 6,234,218 | B1 | * | 5/2001 | Boers | 141/83 |

* cited by examiner

*Primary Examiner*—Timothy L. Maust
(74) *Attorney, Agent, or Firm*—O'Melveny & Myers LLP

(57) ABSTRACT

A system and method is provided for automatically dispensing paint from an industry standard paint container to maintain a given level of paint in a paint roller tray. An upwardly open vessel, containing a lower surface and a plurality of walls, houses a valve actuator, which contacts a dispensing lid to release paint from an industry standard paint container. The lower surface of the upwardly open vessel is further divided into a lower, paint reservoir surface and an upper, shallow surface. An elevated surface is formed over the paint reservoir surface to support an inverted dispensing lid attached to an industry standard paint container. The dispensing lid contains an inner spring-like flange, which allows the dispensing lid to be attached to an industry standard paint container. The dispensing lid further contains a valve. When the dispensing lid, and attached paint container are inverted and placed upon the elevated surface of the upwardly open vessel, the valve actuator comes into contact with the valve. This contact allows paint to flow from the industry standard paint container, down over the valve actuator, and onto the paint reservoir surface. Gravity allows the paint to flow in this manner, maintaining a level of paint over the paint reservoir surface equal to the lowest point of the paint in the dispensing lid.

24 Claims, 4 Drawing Sheets

SYSTEM AND METHOD FOR AUTOMATICALLY DISPENSING PAINT INTO A PAINT ROLLER TRAY

BACKGROUND OF THE INVENTION

1. Field of the Invention

The present invention relates to a paint roller tray, and more particularly, to a system and method for automatically dispensing paint into a paint roller tray.

2. Description of Related Art

One of the most painstaking chores that each and every homeowner faces is the chore of house painting. Not only is the painting of one's house time consuming, but it has a reputation for being an extremely messy job. To complete this job most homeowners (as well as professionals) utilize a paint roller. A paint roller is a paint application device comprising a handle and a cylindrically absorbent tube. The absorbent tube is attached to the handle in a manner that allows the absorbent tube to rotate about an axis perpendicular to the handle. A paint roller is a commonly used application device because it allows a painter to apply a uniform layer of paint to a particular surface in a relatively short period of time.

A paint roller is designed to be used together with a paint tray. A traditional paint tray is a vessel that usually slopes downward, forming a lower, paint reservoir area, and an upper, shallow surface area. The paint reservoir area is where the available paint for the paint roller resides. When additional paint is needed on the paint roller, the absorbent end of the paint roller is rolled through the paint reservoir. The shallow surface area, which usually slopes away from the paint reservoir area, provides a surface above the reservoir paint line where excess paint can be removed from the paint roller. The paint roller is rolled over this shallow surface in an effort to squeeze out any excess paint from the paint roller.

Although a traditional paint tray provides a paint reservoir, this reservoir is initially empty, thus requiring a painter to add paint before the paint tray can be used together with the paint roller. Paint is usually provided to consumers in an industry standard one-gallon paint can. The pouring of the paint from a one-gallon paint can into a paint reservoir can be a very messy process. The paint will have a tendency to drip and splatter if the one-gallon paint can is tilted too rapidly, too leisurely, or from too high of an elevation. Returning the one-gallon paint can too slowly to its upright position can also cause the paint to drip. Even if one has managed to successfully pour the paint into the paint reservoir without any dripping or splattering, some excess paint will end up residing in the lid-groove on top of the one-gallon paint can, whereas such excess paint could splatter upon the forceful reattachment of the paint lid.

Not only is the paint pouring process messy, but it is also time consuming. That is because paint must constantly be added to the paint reservoir to maintain a paint source for the paint roller. As paint is taken out of the paint tray reservoir, via the paint roller, the paint level of the paint reservoir will decrease. Once the paint in the paint reservoir is depleted, the painter must set down the roller, retrieve the one-gallon paint can, and pour additional paint into the paint reservoir. This messy, time consuming process of adding paint to the paint reservoir ultimately discourages consumers from using a paint roller/tray combination.

There have been attempts to redesign paint trays to eliminate the problems discussed above. One such attempt involved affixing a paint tray directly to the top of an open can of paint, which allowed the user to pick up the tray/can combination and transfer the paint from the can to the tray by tilting the whole assembly on its side until the proper amount of paint resided in the paint reservoir. Another attempt involved attaching flexible bags of paint to a paint tray via a hose or tube, which allowed the user to transfer paint into the paint reservoir by manually lift the bags of paint to an elevation higher than the paint tray. However, designs like these still require manual intervention to add paint to the paint reservoir. They also require the painter to pour the paint from the original one-gallon paint can into a special can or bag that can be attached to the paint tray.

A need exists in the industry, and it would be very desirable, to have a system and method for automatically dispensing paint from an industry standard paint container into a paint roller tray.

SUMMARY OF THE INVENTION

The present invention provides a system and method for automatically dispensing paint from an industry standard paint container to maintain a given level of paint in a paint roller tray. More particularly, the invention provides an upwardly open vessel, housing a valve actuator, that comes into contact with a dispensing lid to release paint from an industry standard paint container.

In an embodiment of the invention, the upwardly open vessel includes a lower surface and a plurality of walls extending upward from the lower surface. The lower surface is further divided into a lower, paint reservoir surface and an upper, shallow surface. The paint reservoir surface is a substantially horizontal surface defining the lowest interior fluid point of the upwardly open vessel. The shallow surface is an angled surface, sloping away from the paint reservoir surface. When paint is added to the upwardly open vessel, it initially collects over the paint reservoir surface, creating a reservoir of available paint. When additional paint is needed on the paint roller, the absorbent end of the paint roller is rolled through the reservoir of available paint. The shallow surface, which slopes away from the paint reservoir surface, provides a surface above the reservoir paint line where the paint roller can be rolled to squeeze out any excess paint from the paint roller.

The upward open vessel further contains an elevated surface over the paint reservoir surface, which is supported by at least one of the plurality of walls. The elevated surface is located near the valve actuator and provides a platform that supports the dispensing lid in an inverted position. The dispensing lid, which can be attached to an industry standard paint container, includes a valve. When the dispensing lid is placed upon the elevated surface, the valve actuator comes into contact with the valve in the dispensing lid, allowing paint to flow from the industry standard paint container, through the valve in the dispensing lid, and into the upwardly open vessel.

The valve in the dispensing lid further comprises a fluid opening, a sealing flap, a pivotal arm, an axial structure, and a biasing spring. A first end of the pivotal arm is attached to the axial structure, allowing a second end of the pivotal arm to swing toward the fluid opening. The second end of the pivotal arm, which is attached to the sealing flap, is biased toward the fluid opening through the biasing spring. When the valve actuator presses against the sealing flap, the sealing flap and the second end of the pivoting arm are retracted away from the fluid opening. By retracting the sealing flap away from the fluid opening, paint from the industry standard paint container can flow through the fluid opening into the upwardly open vessel.

The dispensing lid further includes an inner spring-like flange. The inner spring-like flange allows the dispensing lid to be attached to an industry standard container of paint. The container most commonly used by the paint industry to store paint is a one-gallon paint can. The one-gallon paint can further includes a paint can and a paint lid. The paint lid has a spring-like flange that is designed to mate with an upper-oriented groove in the paint can. By applying downward pressure to the paint lid, the spring-like flange seats within the upper-oriented groove in the paint can, causing a seal between the two components. The inner spring-like flange on the dispensing lid acts in the same manner as the spring-like flange found on the paint lid, thus allowing the dispensing lid to replace the paint lid traditionally attached to the one-gallon paint can. Once the dispensing lid is placed upon the one-gallon paint can, the one-gallon paint can and the dispensing lid can be inverted and placed upon the upwardly open vessel.

The lid structure further includes an alignment flange and an alignment tube. The alignment flange is designed to be slightly larger than the elevated surface and the alignment tube is designed to be slightly larger than the valve actuator. The dispensing lid, attached to the one-gallon paint can, is guided onto the upwardly open vessel through the aid of the alignment tube and the alignment flange. The alignment tube is first guided over the valve actuator, allowing the dispensing lid to be fully lowered onto the elevated surface. The dispensing lid can be properly aligned on the elevated surface through the aid of the outer alignment flange, which surrounds the elevated surface and help maintain the one-gallon paint can in an upright position.

When the dispensing lid is placed on the upwardly open vessel, the valve actuator comes into contact with the sealing flap. This contact pushes the sealing flap and the second end of the pivotal arm away from the fluid opening, thus allowing paint to flow from the one-gallon paint can, down over the valve actuator, onto the paint reservoir surface. Gravity will continue to allow paint to flow in this manner until the paint level over the paint reservoir surface raises to the lowest point of the paint contained in the alignment tube. As paint is removed from the paint tray system, via the paint roller, gravity will maintain the level of paint over the paint reservoir surface equal to the lowest point of paint contained in the alignment tube. When the dispensing lid and one-gallon paint can are removed from the upwardly open vessel, the biasing spring will return the sealing flap and the second end of the pivotal arm to their original positions over the fluid opening, thus preventing any additional paint from dripping out of the one-gallon paint can.

A more complete understanding of the paint roller tray system and method will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a system and method for automatically dispensing paint from an industry standard paint container to maintain a given level of paint in a paint roller tray. In the detailed description that follows, like element numerals are used to describe like elements illustrated in one or more figures.

Figure 1:
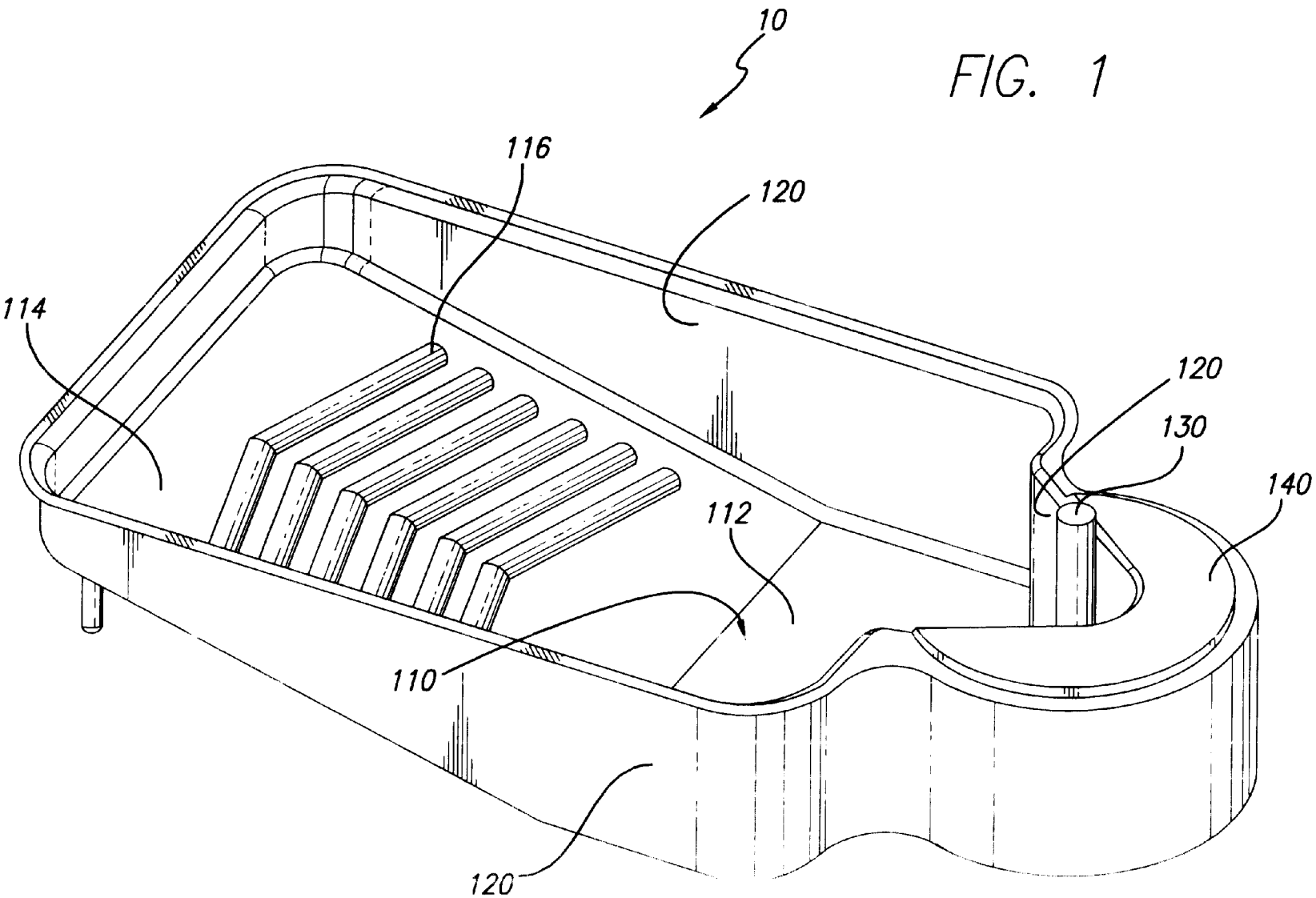
FIG. 1 is a perspective view of a paint tray in accordance with an embodiment of the invention.

Preferred embodiments of the present invention operate in accordance with an upwardly open vessel, a valve actuator, and a dispensing lid. FIG. 1 depicts an upwardly open vessel and a valve actuator coupled together to create a paint roller tray system 10 that operates in accordance with the preferred embodiment of the invention.

Referring to FIG. 1, the paint tray system 10 includes a lower surface 110 and a plurality of walls 120 and a valve actuator 130 extending upwardly from the lower surface 110. The valve actuator 130 is utilized to release paint from a valve contained in the dispensing lid (described below with respect to FIGS. 3 and 4). It should be appreciated that the attachment of the valve actuator 130 to the lower surface 110 of the paint tray system 10, as depicted in FIG. 1, is not intended to limit the valve actuator. Other valve actuators generally known to those skilled in the art (both as to construction and attachment) are within the scope and spirit of this invention.

Figure 2:
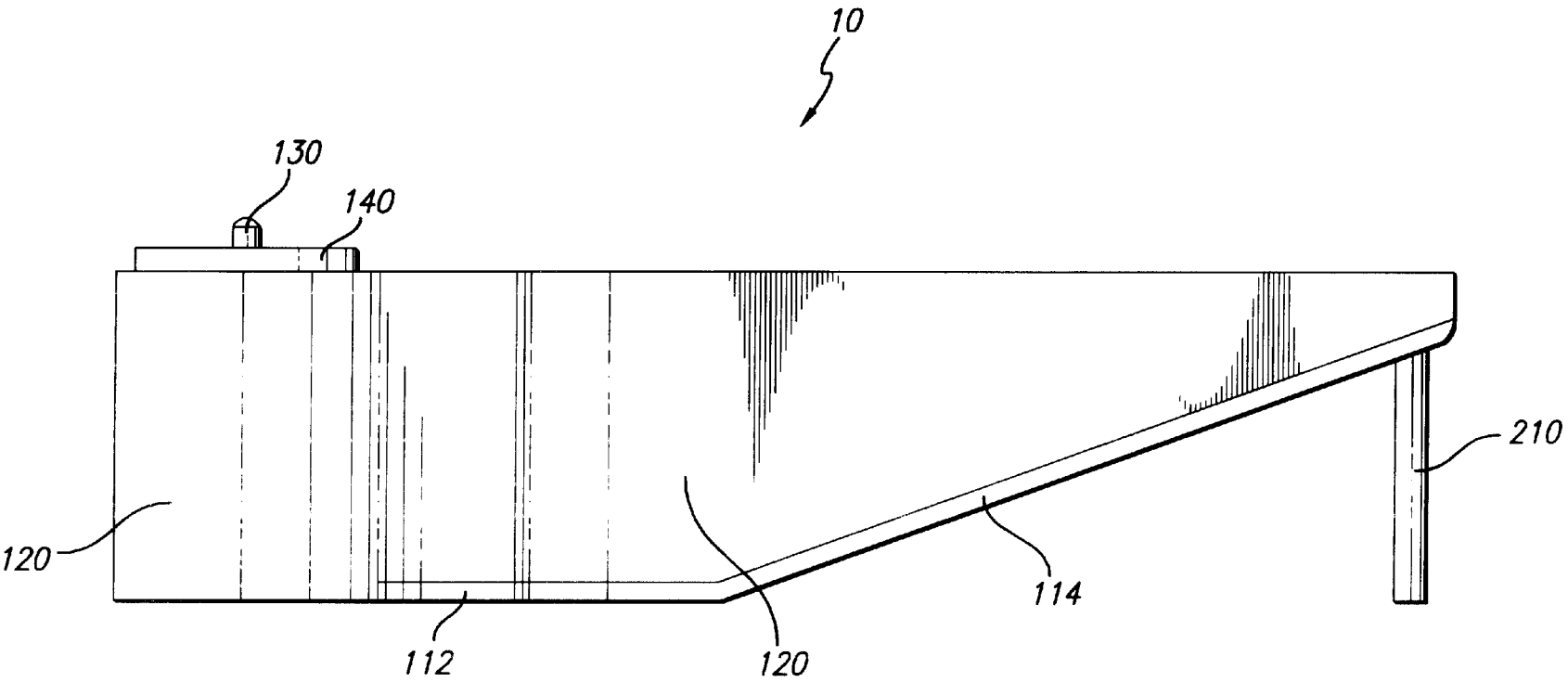
FIG. 2 is a side view of a paint tray.

The lower surface 110 is further divided into a paint reservoir surface 112 and a shallow surface 114, as depicted in FIG. 1. The paint reservoir surface 112 (as shown in FIGS. 1 and 2) is a substantially horizontal surface defining the lowest interior fluid point in the paint tray system 10. The shallow surface 114 (as shown in FIGS. 1 and 2) is an angled surface, sloping away from the paint reservoir surface 112. The shallow surface 114 is supported at its highest elevation by a support structure 210, as shown in FIG. 2. In an embodiment of the invention, the shallow surface 114 further contains raised irregularities 116, as shown in FIG. 1. It should be appreciated that the raised irregularities shown in FIG. 1 are merely exemplary in nature, and other embodiments containing raised irregularities of a different shape, size, and/or location are within the scope and spirit of this invention.

When paint is added to the paint tray system 10, it initially collects over the paint reservoir surface 112, since it is the lowest interior fluid point in the paint tray system 10. As additional paint is added to the paint tray system 10, the paint initially collects over the paint reservoir surface 112, creating a reservoir of available paint. When additional paint is needed on the paint roller, the absorbent end of the paint roller is rolled through the reservoir of available paint. The shallow surface 114, which slopes away from the paint reservoir surface 112, provides a surface above the reservoir paint line where excess paint can be removed from the paint roller. The paint roller is rolled over this shallow surface 114, and over the raised irregularities 116, in an effort to squeeze out any excess paint from the paint roller.

The paint tray system 10 further contains an elevated surface 140, which is supported by at least one of the plurality of walls 120. Although the elevated surface appears semi-circular from above (see FIG. 1) and resides at a higher elevation than the plurality of walls (see FIG. 2), it should be appreciated that other embodiments (shape, location, and elevation) are within the scope and spirit of this invention.

The elevated surface 140 provides a platform on which an inverted dispensing lid can reside.

Figure 3:
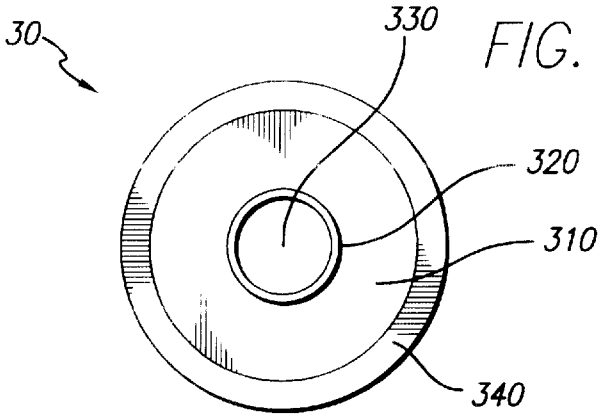
FIG. 3 is a front view of a dispensing lid.
Figure 4:
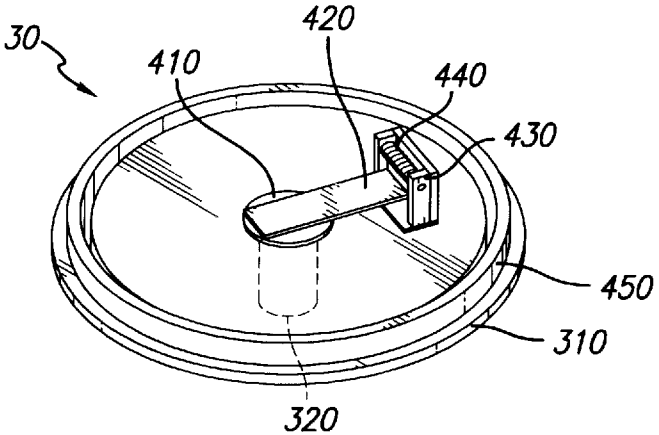
FIG. 4 is a perspective view of a dispensing lid.

FIGS. 3 and 4 depict a dispensing lid 30 that operates in accordance with one embodiment of the invention. The dispensing lid 30 contains a valve including a fluid opening 330 in a lid structure 310 and a sealing flap 410 capable of covering, and sealing the fluid opening 330. The sealing flap 410 is attached to a second end of a pivotal arm 420, which can pivot on an axial structure 430 attached to the inside of the lid structure 310. The second end of pivotal arm 420, along with the sealing flap 410, are continuously urged toward the fluid opening 330 by the biasing spring 440. It should be appreciated that other valve systems generally familiar to those skilled in the art are within the scope and spirit of this invention.

When the valve is in a resting position (i.e., not activated) it is closed. This is because the biasing spring 440 continually urges the pivotal arm 420, and thus the sealing flap 410, toward the fluid opening 330 in the lid structure 310. When the dispensing lid 30 is placed on a container, the sealing flap 410 pressed against the fluid opening 330 prevents fluids within the container from exiting through the fluid opening 330. When the valve actuator 130 is pressed against the sealing flap 410, both the sealing flap 410 and the pivotal arm 420 are retracted away from the fluid opening 330, thus allowing fluids within the container to travel through the fluid opening 330.

Figure 5:
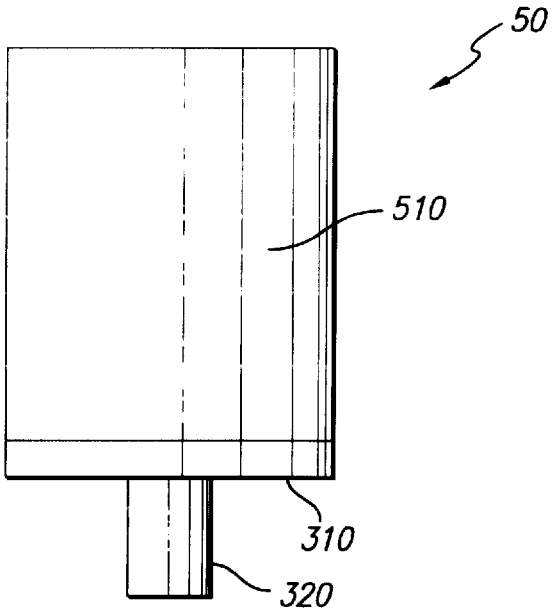
FIG. 5 is a side view of a paint can fitted with a dispensing lid.

The lid structure 310 further includes an inner spring-like flange 450. The inner spring-like flange 450 allows the dispensing lid 30 to be attached to an industry standard container of paint. The container most commonly used by the paint industry to store paint is a one-gallon paint can. The one-gallon paint can includes a paint can and a paint lid. The paint lid has a spring-like flange that is designed to mate with an upper-oriented groove in the paint can (none of which is shown in the drawings). By applying downward pressure to the paint lid, the spring-like flange seats within the upper-oriented groove in the paint can, causing a seal between the two components. The inner spring-like flange 450 on the lid structure 310 acts like the spring-like flange found on the paint lid, thus allowing the dispensing lid 30 to replace the paint lid traditionally attached to an industry standard one-gallon paint can. A one-gallon paint can 510 fitted with the dispensing lid 30, as shown in FIG. 5, creates a system paint source 50 for the paint tray system 10 (see FIG. 1). It should be noted that this system paint source 50 can be inverted without any paint being spilt. This is due to the effectiveness of the spring-like flange 450 and the valve in the dispensing lid 30, which is biased in the closed position. It should be appreciated that other lid structures adapted to fit a one-gallon paint can, including, but not limited to, a lid structure containing a cork-like inner flange, a lid structure elastically adapted to fit over a one-gallon paint can, and all other lid structures generally known to those skilled in the art are within the scope and sprit of this invention.

The lid structure 310 further includes an alignment flange 340 and an alignment tube 320 (see FIGS. 3 and 4). The alignment flange 340 is designed to be slightly larger than the elevated surface 140 depicted in FIG. 1. The alignment tube 320 is designed to be larger than the valve actuator 130 also depicted in FIG. 1. The system paint source 50 (FIG. 5) is guided onto the paint tray system 10 (FIG. 1) with the aid of the alignment tube 320 and the alignment flange 340. The alignment tube 320 is guided over the valve actuator 130, allowing the system paint source 50 to be fully lowered onto the paint tray system 10. The lid structure 310 can then be aligned on the elevated surface 140 of the paint tray system 10 through the aid of the outer alignment flange 340, which surrounds the elevated surface 140 and helps maintain the system paint source 50 in an upright position. From this it is clear that the alignment tube 320 and the alignment flange 340 provide a method for aligning the system paint source 50 on the paint tray system 10, as well as provide continued stability between these two components.

Figure 6:
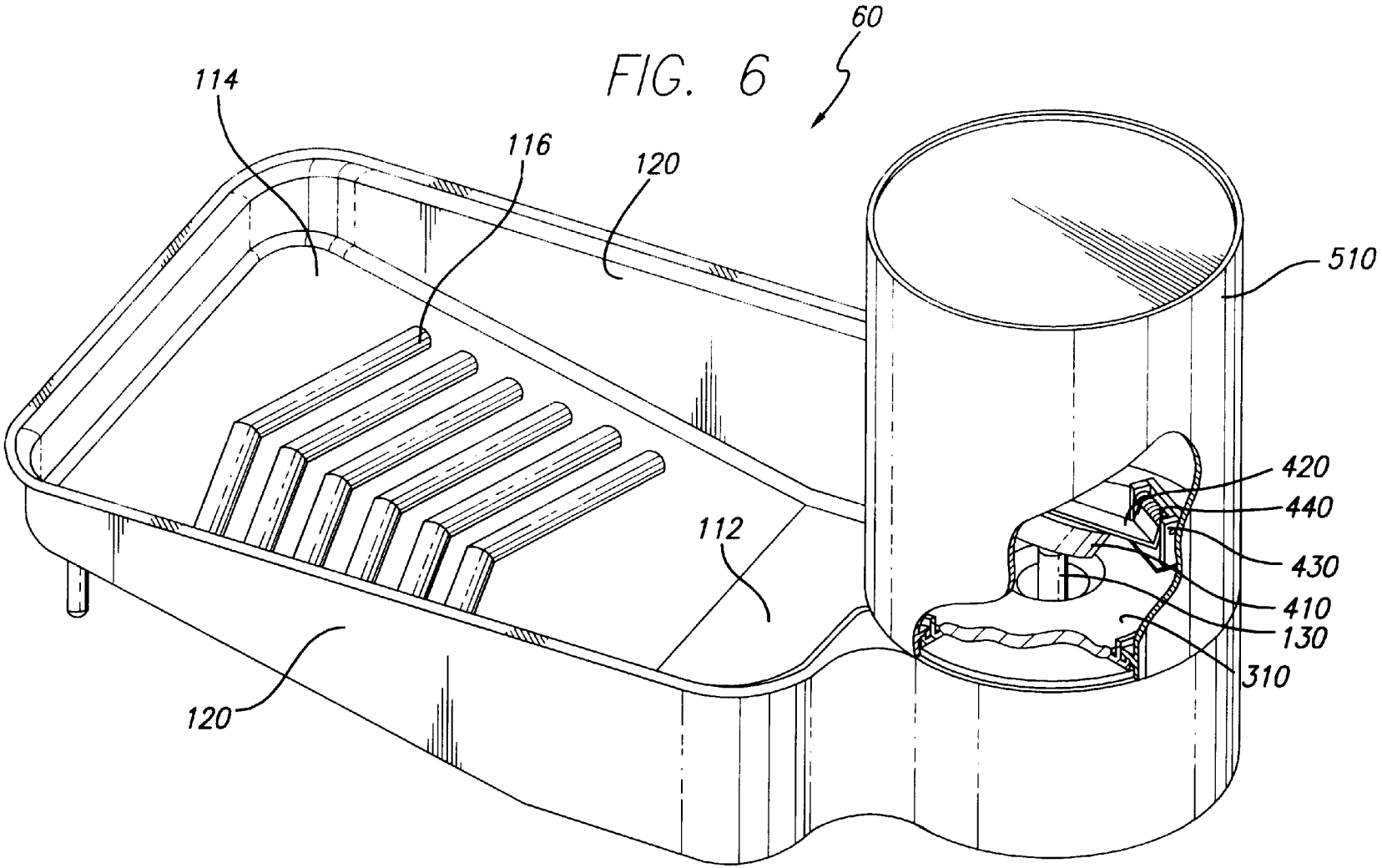
FIG. 6 is a perspective view of a paint can fitted with a dispensing lid, inverted on a paint tray.

FIG. 6 shows the system paint source 50 lowered onto a paint tray system 10, forming an automatic paint tray system 60. As can be seen in FIG. 6, when the system paint source 50 is placed on the paint tray system 10, the valve actuator 130 comes into contact with the sealing flap 410. This contact pushes the sealing flap 410 and the second end of the pivotal arm 420 away from the fluid opening 330, thus allowing paint to flow from the one-gallon paint can 510, over the valve actuator 130, and onto the paint reservoir surface 112. Gravity will continue to allow paint to flow in this manner until the paint level over the paint reservoir surface 112 rises to the lowest point of paint contained in the alignment tube 320. As paint is removed from the paint tray system 10, via the paint roller, gravity will maintain the level of paint over the paint reservoir surface 112 equal to the lowest point of paint contained in the alignment tube 320. When the system paint source 50 is removed from the paint tray system 10, the biasing spring 440 will return the sealing flap 410 and the second end of the pivotal arm 420 to their original positions over the fluid opening 330, thus preventing any additional paint from dripping out of the system paint source 50.

Having thus described a preferred embodiment of a system and method for automatically dispensing paint from an industry standard paint container to maintain a given level of paint in a paint roller tray, it should be apparent to those skilled in the art that certain advantages of the system have been achieved. It should also be appreciated that various modifications, adaptations, and alternative embodiments thereof may be made within the scope and spirit of the present invention. The invention is further defined by the following claims.

What is claimed is:

1. A paint dispensing system for use with a paint can comprising:

an open vessel having a lower surface and a plurality of walls extending upwardly from said lower surface to define a paint reservoir;

a dispensing lid adapted to engage said paint can, wherein said dispensing lid includes a valve; and a valve actuator disposed in said vessel, said valve actuator being adapted to engage with said valve to release paint from said paint can into said paint reservoir.

2. The paint dispensing system according to claim 1, wherein said dispensing lid further includes a spring-like flange adapted to engage a corresponding groove of said paint can in order to secure said dispensing lid to said paint can.

3. The paint dispensing system according to claim 1, wherein said paint can further comprises a one-gallon paint can.

4. The paint dispensing system according to claim 1, wherein said dispensing lid further comprises an opening, and said valve further comprises:

a sealing flap pivotally connected to said dispensing lid, said sealing flap being pivotal between a first position covering said opening and a second position uncovering said opening; and a biasing spring adapted to bias said sealing flap into said first position.

5. The paint dispensing system according to claim 1, wherein said vessel further comprises an elevated surface disposed above at least a portion of said lower surface, wherein said elevated surface is adapted to support said dispensing lid engaged with said paint can in an inverted position.

6. The paint dispensing system according to claim 5, wherein said dispensing lid further includes an alignment tube adapted to surround said valve actuator when said dispensing lid and said paint can are disposed on said elevated surface.

7. The paint dispensing system according to claim 6, wherein said dispensing lid further includes an alignment flange adapted to engage a corresponding ridge of said elevated surface.

8. The paint dispensing system according to claim 6, wherein said lower surface further comprises:

a paint reservoir surface; and a shallow surface sloping away from said paint reservoir surface and disposed between said paint reservoir surface and said elevated surface.

9. The paint dispensing system according to claim 8, wherein said shallow surface further comprises a plurality of raised irregularities adapted to aid in the removal of excess paint from a paint roller.

10. A paint dispensing system for use with a paint can comprising:

an open vessel having a lower surface and a plurality of walls extending upwardly from said lower surface to define a paint reservoir; and means for maintaining paint in said paint can when said paint can is inverted and disengaged from said open vessel and automatically dispensing paint from said paint can into said paint reservoir to maintain a predetermined level of paint in said paint reservoir in response to said paint can being engaged with said open vessel.

11. A paint dispensing system for use with a paint can comprising:

an open vessel having a lower surface and a plurality of walls extending upwardly from said lower surface to define a paint reservoir; and means for automatically dispensing paint from said paint can into said paint reservoir to maintain a predetermined level of paint in said paint reservoir, wherein said paint dispensing means further comprises a dispensing lid, wherein said dispensing lid further includes a spring-like flange adapted to engage a corresponding groove of said paint can in order to secure said dispensing lid to said paint can.

12. The paint dispensing system according to claim 11, wherein said paint can further comprises a one-gallon paint can.

13. The paint dispensing system according to claim 11, wherein said dispensing lid further comprises an opening and a valve, wherein said valve further comprises:

a sealing flap pivotally connected to said dispensing lid, said sealing flap being pivotal between a first position covering said opening and a second position uncovering said opening; and a biasing spring adapted to bias said sealing flap into said first position.

14. The paint dispensing system according to claim 11, wherein said paint dispensing means further comprises a valve actuator disposed in said vessel.

15. The paint dispensing system according to claim 14, wherein said paint dispensing means further comprises an elevated surface adapted to support said dispensing lid engaged with said paint can in an inverted position.

16. The paint dispensing system according to claim 15, wherein said dispensing lid further includes an alignment tube adapted to surround said valve actuator when said dispensing lid and said paint can are disposed on said elevated surface.

17. The paint dispensing system according to claim 16, wherein said dispensing lid further includes an alignment flange adapted to engage a corresponding ridge of said elevated surface.

18. The paint dispensing system according to claim 17, wherein said lower surface further comprises:

a paint reservoir surface; and a shallow surface sloping away from said paint reservoir surface and disposed between said paint reservoir surface and said elevated surface, wherein said shallow surface further comprising a plurality of raised irregularities adapted to aid in the removal of excess paint from a paint roller.

19. A paint dispensing system for use with a paint can comprising:

an open vessel including a lower surface and a plurality of walls extending upward from said lower surface to define a paint reservoir;

a valve actuator disposed in said vessel; and a dispensing lid adapted to engage said paint can, wherein said dispensing lid includes an opening and a valve adapted to engage with said valve actuator to release paint from said paint can into said paint reservoir, wherein said valve further comprises:

a sealing flap pivotally connected to said dispensing lid, said sealing flap being pivotal between a first position covering said opening and a second position uncovering said opening; and a biasing spring adapted to bias said sealing flap into said first position.

20. The paint dispensing system according to claim 19, wherein said dispensing lid further includes a spring-like flange adapted to engage a corresponding groove of said paint can in order to secure said dispensing lid to said paint can.

21. The paint dispensing system according to claim 19, wherein said vessel further comprises an elevated surface disposed above at least a portion of said lower surface, wherein said elevated surface is adapted to support said dispensing lid engaged with said paint can in an inverted position.

22. The paint dispensing system according to claim 19, wherein said dispensing lid further includes an alignment tube adapted to surround said valve actuator when said dispensing lid and said paint can are disposed on said elevated surface.

23. The paint dispensing system according to claim 19, wherein said lower surface further comprises a plurality of raised irregularities adapted to aid in the removal of excess paint from a paint roller.

24. The paint dispensing system according to claim 19, wherein said paint can further comprises a one-gallon paint can.

* * * * *